US006873094B2

(12) United States Patent
Hiramatsu et al.

(10) Patent No.: US 6,873,094 B2
(45) Date of Patent: Mar. 29, 2005

(54) IGNITION DEVICE FOR INTERNAL COMBUSTION ENGINE AND A MANUFACTURING METHOD THEREFOR

(75) Inventors: Hiromi Hiramatsu, Kariya (JP); Masamichi Shibata, Toyota (JP); Hirofumi Suzuki, Kuwana (JP); Tetsuya Miwa, Nagoya (JP)

(73) Assignee: Denso Corporation, Kariya (JP)

( * ) Notice: Subject to any disclaimer, the term of this patent is extended or adjusted under 35 U.S.C. 154(b) by 1 day.

(21) Appl. No.: 10/401,603

(22) Filed: Mar. 31, 2003

(65) Prior Publication Data

US 2003/0184202 A1 Oct. 2, 2003

(30) Foreign Application Priority Data

Apr. 1, 2002 (JP) ..... 2002-098510
Jan. 28, 2003 (JP) ..... 2003-019040

(51) Int. Cl.[7] ..... H01T 13/22
(52) U.S. Cl. ..... 313/144; 313/137; 313/135
(58) Field of Search ..... 313/128, 135, 313/136, 137, 141, 144, 145

(56) References Cited

U.S. PATENT DOCUMENTS 4,568,855 A * 2/1986 Nemeth et al. ..... 315/59

FOREIGN PATENT DOCUMENTS

| | | |
|---|---|---|
| EP | 907019 | 4/1999 |
| JP | 2000-252040 | 9/2000 |
| JP | 2000-27723 | 10/2000 |

* cited by examiner

*Primary Examiner*—Vip Patel
(74) *Attorney, Agent, or Firm*—Nixon & Vanderhye P.C.

(57) ABSTRACT

In an ignition device for an internal combustion engine which is mounted in a cylinder head in a state where a spark plug and an ignition coil are integrated with each other, the plug side tube section is made of ceramics and internally accommodates a center electrode and the coil side tube section is made of ceramics, with one of a primary winding and a secondary winding being wound around the coil side tube section. The plug side tube section and the coil side tube section are constructed as separate bodies and then combined with each other. This shortens the overall lengths of both the tube sections, thus preventing the occurrence of cracks or bends at calcining and improving the dimension accuracy after the calcining.

7 Claims, 5 Drawing Sheets

IGNITION DEVICE FOR INTERNAL COMBUSTION ENGINE AND A MANUFACTURING METHOD THEREFOR

BACKGROUND OF THE INVENTION

1) Field of the Invention

The present invention relates to an ignition device for use in an internal combustion engine in which a spark plug and an ignition coil are integrated with each other, and further to a manufacturing method therefor.

2) Description of the Related Art

So far, as ignition devices for use in internal combustion engines, there have been proposed various types (see Japanese Patent Laid-Open Nos. 2000-252040 and 2000-277232 and European Patent Laid-Open No. 0907019). In such types of ignition devices, a center electrode and a stem are built in a ceramics-made insulator, and each of a primary winding and a secondary winding are wound around a resin-made spool.

Meanwhile, the present inventors have studied the replacement of one of two spools with a ceramic type and the formation of an insulator 5 in which a plug side tube section 51, internally including a center electrode and a stem, and a coil side tube section 52 forming the ceramic spool are integrated with each other as shown in FIG. 5 for the purpose of the cost reduction based on the structural simplification. However, this has indicated the following problems.

That is, in this case, the overall length of the insulator 5 becomes prolonged, which creates problems in that cracks or bends occurs at calcining and the dimension accuracy after calcining deteriorates. Incidentally, although these problems are solvable if a calcined material is internally whittled to form a hollow configuration, this increases the manufacturing cost significantly and, hence, is of no practical use.

In addition, for the plug, the interior of an insulator is packed with a seal material made of a mixture of copper and glass so that the seal material is melted and then solidified to form a seal layer. However, in a case in which the plug side tube section 51 and the coil side tube section 52 are integrally constructed as shown in FIG. 5, since the seal material is put thereinto through an opening of the coil side tube section 52 forming a deep hole, difficulty is experienced in carrying out the packing operation.

Still additionally, in the formation of the seal layer, there is a need to press down the stem through the use of a jig for the purpose of preventing the lift of the stem resulting from the expansion of the seal material and the jig is required to be inserted through the opening of the coil side tube section 52. However, difficulty is encountered in accomplishing the jig insertion work and in maintaining the stem pressed state by the jig.

SUMMARY OF THE INVENTION

The present invention has been developed in consideration of the above-mentioned problems and it is therefore an object of the invention to, in an ignition device for use in an internal combustion engine in which a spark plug and an ignition coil are integrated with each other and are mounted in a cylinder head, eliminate the problems arising in the integration of a plug side tube section and a coil side tube section.

For this purpose, in accordance with a first aspect of the present invention, there is provided an ignition device for an internal combustion engine which is equipped with a spark plug (2) made to carry out an electric discharge between an center electrode (22) and an earth electrode (23) and an ignition coil (3) having a primary winding (31) and a secondary winding (32) for supplying a high voltage to the spark plug (2), with the spark plug (2) and the ignition coil (3) being mounted in a cylinder head of the internal combustion engine in an integrated condition, the ignition device comprising a ceramic plug side tube section (51, 151) internally accommodating the center electrode (22) and a ceramic coil side tube section (52, 152) on which one of the primary winding (31) and the secondary winding (32) is wound, the plug side tube section (51, 151) and the coil side tube section (52, 152) being formed as separate bodies and then combined with each other.

Thus, since the plug side rube section and the coil side tube section are formed in a separate condition, the overall length of each of the tube sections becomes short, which prevents the occurrence of cracks or bends at calcining and improves the dimension accuracy after the calcining.

In addition, an operation for the formation of a seal layer in the interior of the plug side tube section can be conducted prior to the combination of the plug side tube section and the coil side tube section. In this case, the operation can easily be done as in the case of a conventional art.

Furthermore, in accordance with a second aspect of the present invention, there is provided a method of manufacturing an ignition device for an internal combustion engine which is equipped with a spark plug (2) made to carry out an electric discharge between an center electrode (22) and an earth electrode (23) and an ignition coil (3) having a primary winding (31) and a secondary winding (32) for supplying a high voltage to the spark plug (2), with the spark plug (2) and the ignition coil (3) being mounted in a cylinder head of the internal combustion engine in an integrated condition, the method comprising the steps of forming a ceramic plug side tube section (51, 151) internally accommodating the center electrode (22) and a ceramic coil side tube section (52, 152), on which one of the primary winding (31) and the secondary winding (32) is wound, as separate bodies and then combining the plug side tube section (51, 151) with the coil side tube section (52, 152) for forming an insulator (5).

This can provide the same effects as those of the first aspect of the present invention.

According to a third aspect of the present invention, after a seal layer formation step is conducted to melt a seal material put in the interior of the plug side tube section (51, 151) and then solidify the seal material, a combination step is conducted to solidify a binding material after melting for combining the plug side tube section (51, 151) with the coil side tube section (52, 152).

Accordingly, since an operation for the formation of a seal layer in the interior of the plug side tube section can be conducted prior to the combination of the plug side tube section and the coil side tube section, the operation can easily be done as in the case of a conventional art.

As a fourth aspect of the present invention, it is also appropriate to simultaneously conduct a seal layer formation step of melting a seal material put in the interior of the plug side tube section (51, 151) and then solidifying the seal material and a combination step of melting a binding material and then solidifying the binding material for combining the plug side tube section (51, 151) with the coil side tube section (52, 152).

This can shorten the manufacturing time because of the simultaneous implementation of the two steps.

In this case, if the melting points of the seal material and binding material are different from each other, as a fifth aspect of the present invention, it is preferable that the site of the seal material and the site of the binding material are heated at different heating temperatures in simultaneously conducting the seal layer formation step and the combination step.

Moreover, according to a sixth aspect of the present invention, a glaze (glost) is applied onto an inner circumferential surface of a combination portion between the plug side tube section (51, 151) and the coil side tube section (52, 152) and is calcined.

Usually, a winding is placed in the interior of the coil side tube section and an insulating resin is put therein, and in a case in which a level difference (step) exists on an inner circumferential surface of the combination portion between both the tube sections, there is an expected problems in that the insulating resin enters the level difference thereon to easily cause cracks on the insulating resin.

For solving this problem, according to the sixth aspect of the present invention, the level difference on the inner circumferential surface of the combination portion between both the tube sections is filled with the glaze to smooth the inner circumferential surface of the combination portion between both the tube sections, thereby preventing the occurrence of cracks of the insulating resin.

Still moreover, according to a seventh aspect of the present invention, the other one of the primary winding (31) and the secondary winding (32) is placed in the interior of the coil side tube section (152), and an inner circumferential surface side interface (A) in the combination portion between the plug side tube section (151) and the coil side tube section (152) is located outside an axial range (B) of the winding placed in the interior of the coil side tube section (152).

Usually, a winding is placed in the interior of the coil side tube section and an insulating resin is put therein, and there is a possibility that the inner circumferential surface side interface of the combination portion between both the tube sections acts as an origination due to thermal stress to cause the occurrence of cracks on the insulating resin. In addition, since there is a tendency that the cracks develop in the radial directions, in a case in which the inner circumferential surface side interface of the combination portion between both the tube sections positioned outside the winding placed in the interior of the coil side tube section, that is, if the interface and the winding overlap with each other, the cracks can reach the winding lying in the interior of the coil side tube section so that the winding is pulled to be broken.

According to the seventh aspect of the present invention, since the interface and the winding are located so as not to overlap with each other, even if cracks occur, the cracks do not reach the winding placed in the interior of the coil side tube section, thus preventing the breakage of the winding.

The reference numerals in parentheses attached to the respective means or components signify the corresponding relation with respect to the concrete means in an embodiment which will be described later.

BRIEF DESCRIPTION OF THE DRAWINGS

Other objects and features of the present invention will become more readily apparent from the following detailed description of the preferred embodiments taken in conjunction with the accompanying drawings in which.

DESCRIPTION OF THE PREFERRED EMBODIMENTS (First Embodiment)

Figure 1:
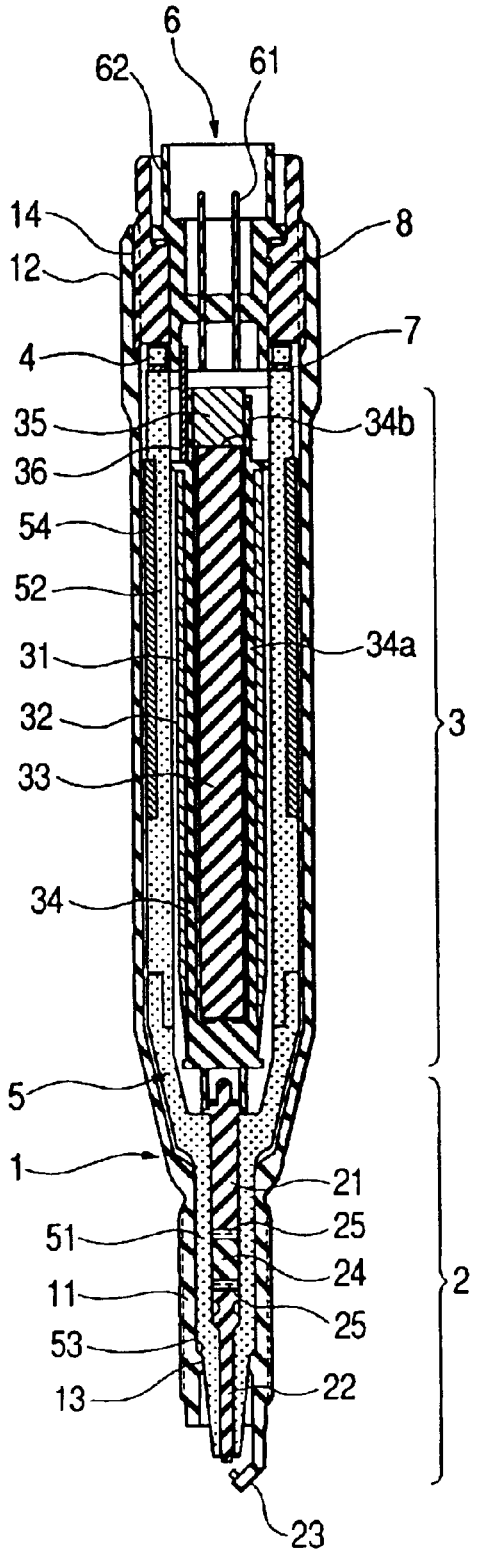
FIG. 1 is a cross-sectional view showing an ignition device according to a first embodiment of the present invention.
Figure 2A:
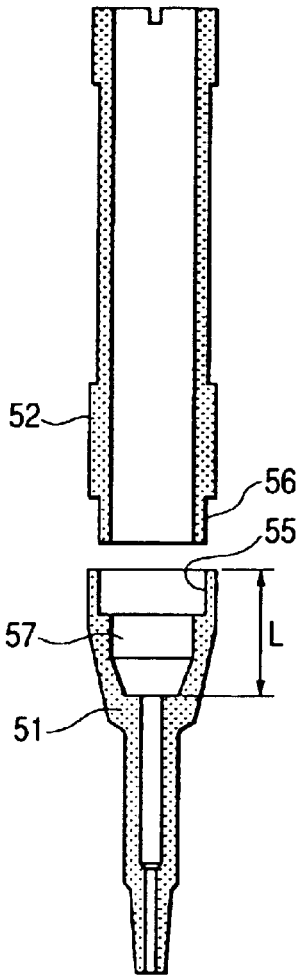
FIGS. 2A, 2B and 2C are cross-sectional views showing a process of manufacturing an insulator 5 shown in FIG. 1.
Figure 2B:
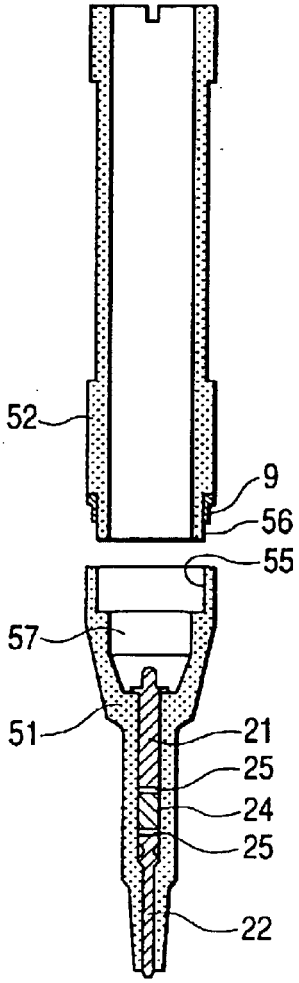
Figure 2C:
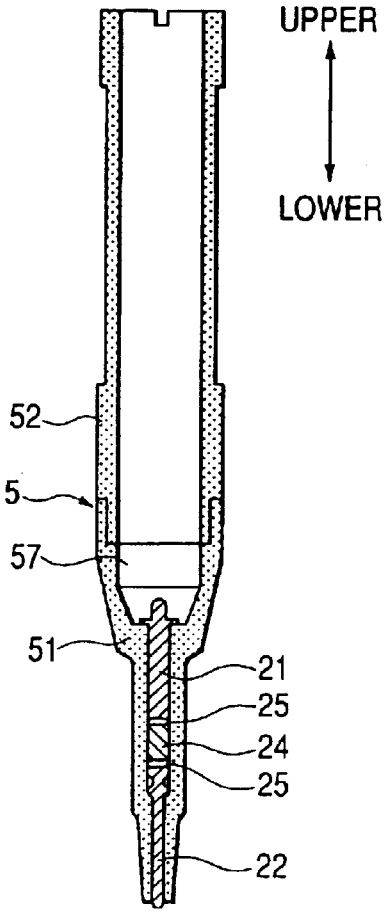

FIGS. 1 and 2A to 2C are illustrations of an ignition device for use in an internal combustion engine according to a first embodiment of the present invention. Of these, FIG. 1 is a cross-sectional view showing the entire construction of the ignition device and FIGS. 2A to 2C are cross-sectional views showing a process of manufacturing an insulator 5 thereof.

As FIG. 1 shows, the ignition device is designed such that a cylindrical case 1 accommodates a spark plug 2, an ignition coil 3 and a pressure detecting element 4, and it is mounted in a plug hole of a cylinder head so that both electrodes of the spark plug 2 (which will be mentioned in detail later) are exposed to a combustion chamber of an internal combustion engine for a motor vehicle.

The case 1 is made of a magnetic and conductive metallic material, more concretely, is made of a steel material such as a carbon steel, and in an outer circumferential surface of the case 1, a male screw portion 11 is made on the combustion chamber side while a tightening nut portion 12 is made on a side opposite to the combustion chamber side. The case 1 is rotated through the use of the nut portion 12 so that the male screw portion 11 engages with a female screw portion (not shown) of the cylinder head, thus fixedly securing the ignition device to the cylinder head.

The case 1 accommodates a cylindrical insulator 5. For this insulator 5, a plug side tube section 51 which is positioned on the combustion chamber side and a coil side tube section 52 which is positioned on the side opposite to the combustion chamber side with respect to the plug side tube section 51 and on which a primary winding 31 (which will be described later) is wound are formed as separate bodies and then combined with each other. A process of manufacturing the insulator 5 will be described later.

The insulator is made of ceramics forming an electrical insulating material, preferably, of a silicon nitride providing an excellent strength, more preferably, of a silicon nitride having a thermal conductivity of more than 50 (W/m·K) providing a superior radiation property for protecting the primary winding 31 from heat.

On an inner circumferential surface of the case 1, a stepped receiving surface 13 is formed in the vicinity of the combustion chamber side, and on an outer circumferential surface of the plug side tube section 51 of the insulator 5, a stepped working (contacting) surface 53 is formed to come into contact with the receiving surface 13. Moreover, a metal-made packing (not shown) is interposed between the receiving surface 13 and the working surface 53 for positioning the insulator 5 with respect to the case 1 in its axial direction and further for preventing the leakage of the combustion gas from a portion between the case 1 and the insulator 5.

The spark plug 2 is composed of a stem 21 made of a conductive metal, a center electrode 22 made of a conductive metal, an earth electrode 23 made of a conductive metal, a resistor layer 24 whose main component is a glass containing carbon powder in a mixed state and having, for example, an electrical resistance of more than 3 kΩ, a seal layer 25 whose main component is a glass containing copper in a mixed state, and others. The seal layer 25 forms an excellent electric conductor and is for preventing the leakage of the combustion gas through a central hole of the plug side tube section 51.

In the central hole of the plug side tube section 51 of the insulator 5, the center electrode 22, the seal layer 25, the resistor layer 24, the seal layer 25 and the stem 21 are arranged in this order when viewed from the combustion chamber side toward the side opposite to the combustion chamber. One end portion of the center electrode 22 is exposed to the combustion chamber, while the earth electrode 23 is integrated with the case 1 by means of welding or the like, and this earth electrode 23 is positioned to be in opposed relation to the one end portion of the center electrode 22.

The ignition coil 3 is composed of a primary winding 31, a secondary winding 32, a cylindrical center core 33 made of a magnetic material, a secondary spool 34 made of an electrical insulating resin and formed into a blind-end type cylindrical configuration, and others.

The primary winding 31 is directly wound around a recess portion 54 in the outer circumferential surface of the coil side tube section 52 of the insulator 5. Moreover, both end portions (terminals) of the primary winding 31 are connected through terminals (not shown) to connector terminals 61 of a connector 6 and, hence, a control signal is inputted from an igniter (not shown) to the primary winding 31.

In the case 1, a section surrounding the center core 33 functions as an outer circumferential core in which a magnetic flux flows, and a magnetic flux generated in the primary winding 31 flows through the center core 33 and the case 1. In addition, in the case 1, the section surrounding the center core 33 has a slit (not shown) formed to extend in an axial direction of the center core 33 for the purpose of preventing a loss stemming from a ring current developing due to a magnetic flux variation.

The secondary spool 34 is equipped with a winding tube section 34*a* on which the secondary winding 32 is wound and a protruding tube section 34*b* protruding from the winding tube section 34*a* toward the side opposite to the combustion chamber side. The secondary winding 32 is wound on an outer circumference of the winding tube section 34*b* and the center core 33 is inserted into a central hole of the secondary spool 34. A core pressing cover 35 made of an elastic material such as a rubber or sponge is inserted into an opening of the central hole of the secondary spool 34 to fill up the central hole of the secondary spool 34.

A high-voltage end portion of the secondary winding 32 is electrically connected through the stem 21 of the spark plug 2, the resistor layer 24 and the seal layer 25 to the center electrode 22. On the other hand, a low-voltage end portion of the secondary winding 32 is electrically connected through parts, i.e., a first terminal 36 and a bolt 8, placed in the interior of the case 1, to the case 1. In other words, the low-voltage end portion of the secondary winding 32 is electrically connected to the earth electrode 23 without being connected through the internal combustion engine.

The pressure detecting element 4 shows a fluctuation of electric potential in accordance with a variation of a load applied thereto, and is made of, for example, lead titanate and is formed into a sheet ring-like configuration. Moreover, the pressure detecting element 4 is located at an end portion of the coil side tube section 52, with one end portion of the pressure detecting element 4 being electrically connected through the bolt 8 and the case 1 to the cylinder head.

In addition, a combustion pressure signal terminal 7 made of an electrical conductive metal and formed into a sheet ring-like configuration is located between the pressure detecting element 4 and the coil side tube section 52. This combustion pressure signal terminal 7 is integrated with a connector terminal 61. Thus, an output signal of the pressure detecting element 4 is outputted to a control unit (not shown).

In this connection, for allowing the pressure detecting element 4 to be located at the end portion of the coil side tube section 52, the end portion of the coil side tube section 52 is made to extend upwardly with respect to the primary winding 31 and the secondary winding 32 on the paper surface of FIG. 1. In other words, the end portion of the coil side tube section 52 is made to protrude toward the side opposite to the combustion chamber with respect to the primary winding 31 and the secondary winding 32.

The bolt 8 is made of a conductive metal and formed into a tube-like configuration. The bolt 8 is screw-engaged with the female screw portion 14 made in the case 1 on the side opposite to the combustion chamber so that the pressure detecting element 4 and the combustion pressure signal terminal 7 are held between the end portion of the coil side tube section 52 and the bolt 8.

In addition, by tightening the bolt 8, a compression preload is applied to the pressure detecting element 4, and contact portions between the receiving surface 13 of the case 1, the working surface 53 of the insulator 5 and the packing (not shown) prevent the leakage of the combustion gas from between the case 1 and the insulator 5.

After the bolt 8 is screw-engaged with the female screw portion 14, a resin-made case 62 of the connector 6 is inserted into a hollow of the bolt 8.

Secondly, referring to FIGS. 2A, 2B and 2C, a description will be given hereinbelow of a process of manufacturing the insulator 5. First, in an insulator formation step, a ceramic powder is molded through a rubber-made pattern and then calcined to separately form the plug side tube section 51 and the coil side tube section 52 as shown in FIG. 2A. At this time, a plug side fitting portion 55 is formed in an inner circumferential surface of the end portion of the plug side tube section 51 on the side opposite to the combustion chamber, while a coil side fitting portion 56 to be inserted into the plug side fitting portion 55 is formed in an outer circumferential surface of the end portion of the coil side tube section 52 on the combustion chamber side.

In this connection, in the plug side tube section 51, the length L from a bottom portion of a high-voltage end accommodating section 57 accommodating a connection portion between the high-voltage end portion of the secondary winding 32 and the step 21 to the end portion thereof on the side opposite to the combustion chamber is preferable to be small (short) from the viewpoint of the workability in a seal layer formation step and a resistor layer formation step which will be described later. On the other hand, in view of preventing the leakage of the high voltage from the high-voltage end portion of the secondary winding 32 through a portion between the plug side fitting portion 55 and the coil side fitting portion 56, it is preferable that the length L is large (long). For the compatibility between the workability and the leakage prevention, it is preferable that the length L is approximately 15 mm.

Moreover, for the purpose of preventing cracks and bends at calcining and of improving the dimension accuracy after the calcining, it is preferable that the length L is less than 50 mm.

Subsequently, there are conducted a seal layer formation step of melting a seal material and then solidifying the seal material and a resistor layer formation step of melting a resistor material and then solidifying the resistor material. Concretely, the center electrode 22 is inserted through the opening of the plug side tube section 51 on the side opposite to the combustion chamber into the central hole of the plug side tube section 51, and a seal material for the formation of the seal layer 25 is put therein and a resistor material for the formation of the resistor layer 24 is put therein and further a seal material for the formation of the seal layer 25 is put therein, before the step 21 is inserted thereinto.

In addition, in a state where the stem 21 is pressed by a jig (not shown) through the opening of the plug side tube section 51 on the side opposite to the combustion chamber, the plug side tube section 51 after the stem 21 and others are built therein is heated to melt the seal materials and the resistor material, then solidifying them for the formation of the seal layers 25 and for the formation of the resistor layer 24 (see FIG. 2B).

Still additionally, a combination step follows which solidifies a binding material after melting it for combining the plug side tube section 51 with the coil side tube section 52. Concretely, an adhesive 9 corresponding to the binding material is applied onto the coil side fitting portion 56 for adhering the plug side tube section 51 to the coil side tube section 52. In order to prevent the adhesive 9 from reaching the inner circumferential surface of the fitting section at the insertion of the coil side fitting portion 56 into the plug side fitting portion 55 for coupling them, the adhesive 9 is applied onto only an area of the coil side fitting portion on the side opposite to the combustion chamber (see FIG. 2B).

For example, in this embodiment, a lead borosilicate glass is used as the adhesive 9, and the lead borosilicate glass, after being powdered and then placed into a slurry state, is applied onto the coil side fitting portion 56. Moreover, the lead borosilicate glass has an alkali content of less than 0.1% for the purpose of securing the voltage proof. Still moreover, the lead borosilicate glass has a melting point (for example, approximately 450° C.) lower than that (approximately 800° C.) of the glass forming the main components of the seal material and the resistor material.

Yet moreover, in this embodiment, the lead borosilicate glass contains lead constituting an environmental load material. Accordingly, it is preferable to use a tin+phosphoric acid glass containing no lead or a quartz glass.

Furthermore, as shown in FIG. 2C, after the plug side fitting portion 55 is fitted over the coil side fitting portion 56, they are heated up to the melting point of the adhesive 9 in a state where the plug side tube section 51 is located at a lower position while the coil side tube section 52 is located at an upper position, thereby melting the adhesive 9. Following this, the adhesive 9 is cooled to be solidified for coupling the plug side tube section 51 with the coil side tube section 52, and the manufacturing process for the insulator 5 comes to an end.

In the ignition device thus constructed, the ignition coil 3 generates a high voltage on the basis of a control signal from an igniter, and the spark plug 2 discharges the high voltage in a spark gap to ignite an air-fuel mixture in the interior of the combustion chamber. Moreover, a pressure generated by the combustion in the interior of the combustion chamber is transmitted through the insulator 5 to the pressure detecting element 4 so that the pressure detecting element 4 receives a compression load. Still moreover, the pressure detecting element 4 issues a voltage output signal corresponding to the load variation.

In this embodiment, since the plug side tube section 51 and the coil side tube section 52 are formed separately, the overall length of each of the tube sections 51 and 52 becomes short, thus preventing the occurrence of cracks or bends at calcining and improving the dimension accuracy after the calcining.

In addition, since the seal formation step and the resistor layer formation step are conducted prior to the combination of the plug side tube section 51 and the coil side tube section 52, the operations in these steps can easily be done as well as the conventional case.

Still additionally, the low-voltage side of the secondary winding 32 and the earth electrode 23 of the spark plug 2 are electrically connected to each other through the case 1, which eliminates the need for a connector terminal and a harness for the electrical connection of the low-voltage side of the secondary winding 32 to the internal combustion engine. This enables the size reduction of the connector 6 and removes the creeping of a wire harness for the electrical connection of the low-voltage side of the secondary winding 32 to the internal combustion engine, thereby enhancing the reliability of the apparatus.

Moreover, the distance between the low-voltage side of the secondary winding 32 and the earth electrode 32 of the spark plug 2 becomes shorter and the number of connections becomes smaller, thus reducing the resistance loss of the discharge circuit to enable efficient ignition.

Still moreover, one end portion of the pressure detecting element 4 is electrically connected through the case 1 to the internal combustion engine, which eliminates the need for a connector terminal and a wire harness for the electrical connection of the one end portion of the pressure detecting element 4 to the internal combustion engine.

Yet moreover, since the end portion of the coil side tube section 52 is made to protrude toward the side opposite to the combustion chamber with respect to the primary winding 31 and the secondary winding 32 so that the pressure detecting element 4 is placed at the end portion of the coil side tube section 52, the signal line of the pressure detecting element 4 can be drawn out to the exterior of the case 1 without passing by the ignition coil 3. Therefore, not only an increase in diameter of the case 1 becomes unnecessary, but also the output signal of the pressure detecting element 4 becomes less susceptible to the influence of the discharge noise from the ignition coil 3, and even the creeping of the signal line or the like becomes unnecessary or facilitated.

In addition, since a compression preload is applied to the pressure detecting element 4 by tightening the bolt 8, it is possible to secure the output accuracy thereof with respect to the pressure fluctuation in the combustion chamber.

Still additionally, since the working surface 53 of the insulator 5 is pressed against the receiving surface 13 by tightening the bolt 8 in a state where a packing (not shown) is interposed therebetween, the contact portion between the receiving surface 13 and the working surface 53 prevents the leakage of the combustion gas from a portion between the case 1 and the insulator 5.

Yet additionally, since the case 1, including the section accommodating the ignition coil components, is integrally made through the use of a metallic material, the heat radiation properties of the ignition coil components are further improvable, as compared with a type in which the ignition coil components are placed in the interior of a resin-made case.

Moreover, since the case 1 itself can function as an outer circumferential core of the ignition coil, unlike the conventional type, there is no need to use an outer circumferential core separately, thus enabling the diameter reduction and cost reduction of the ignition device.

Still moreover, since a slit is made in a section surrounding the center core 33 in the case 1, it is possible to prevent a loss stemming from a ring current developing due to a magnetic flux variation.

Yet moreover, since the windings 31 and 32 of the ignition coil and others are covered with the metal-made case 1 connected through the cylinder head to the ground, owing to the shielding function of the case 1, less leakage of the ignition noise developing in the interior of the ignition coil 3 to the external takes place.

(Second Embodiment)

Figure 3:
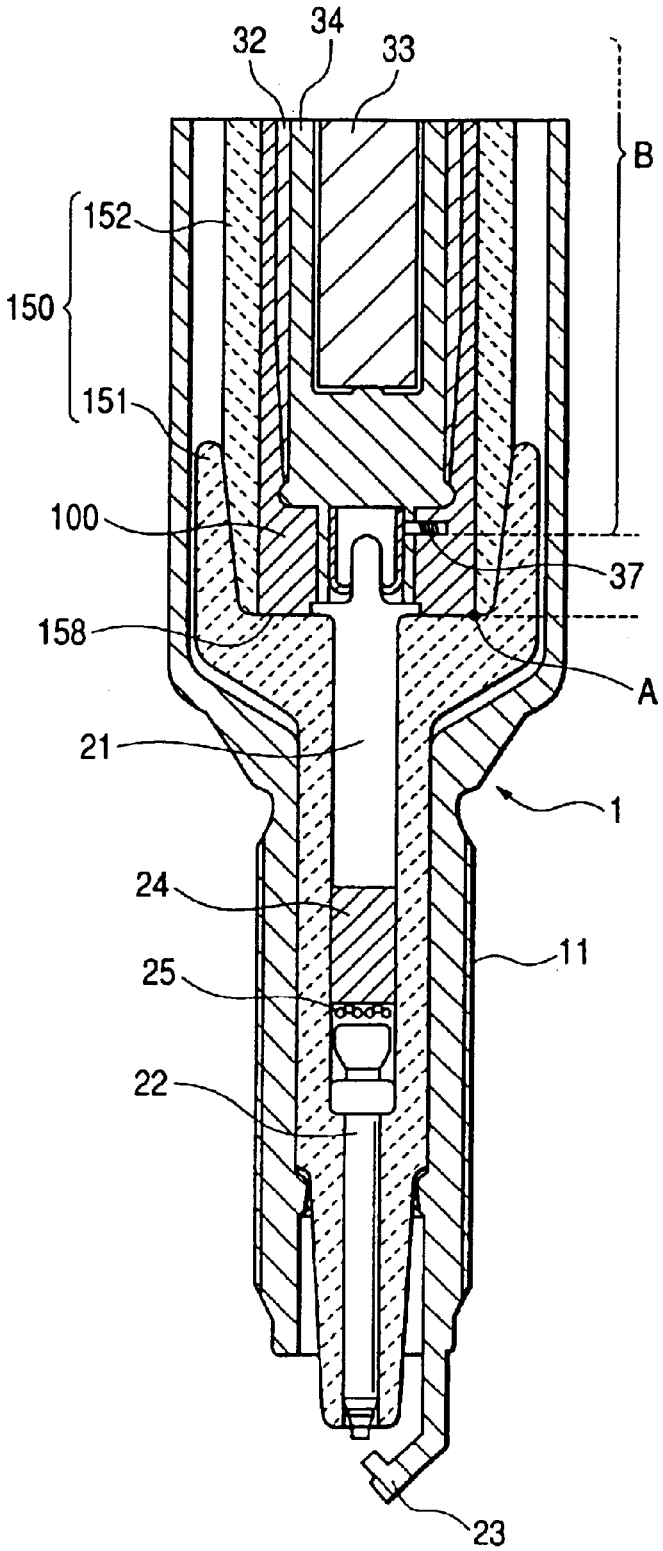
FIG. 3 is a cross-sectional view showing an essential part of an ignition device according to a second embodiment of the present invention.

FIGS. 3 and 4A to 4D are illustrations of an ignition device for use in an internal combustion engine according to a second embodiment of the present invention. The second embodiment differs in configurations of the plug side tube and coil side tube section from the above-described first embodiment. FIG. 3 is a cross-sectional view showing a construction of an essential part of the ignition device and FIGS. 4A to 4D are cross-sectional views showing a process of manufacturing the ignition device. The same reference numerals as those of the first embodiment signify the same or corresponding parts, and the description thereof will be omitted for simplicity.

In FIG. 3, a high-voltage end portion of a secondary winding 32 is wound around a terminal 37 located at a combustion chamber side end portion of a secondary spool 34, and the high-voltage end portion of the secondary winding 32 is electrically connected through the terminal 37 to a stem 21 of a spark plug 2.

An insulator 150 is constructed in a manner such that a plug side tube section 151 made of ceramics and a coil side tube section 152 made of ceramics are formed separately and then combined with each other. The plug side tube section 151 and the coil side tube section 152 are combined with each other in a state where a combustion chamber side end portion of the coil side tube section 152 is inserted into the plug side tube section 151 so as to come into contact with a bottom portion 158 of a high-voltage end accommodating section therein. Therefore, an inner circumferential surface side interface A in the combination portion between the plug side tube section 151 and the coil side tube section 152 coincides or corresponds in position with or to the bottom portion 158 of the plug side tube section 151 and is located outside an axial range (B) of the secondary winding 32.

Between the coil side tube section 152 and the secondary winding 32, an electrical insulating resin is put to form an insulating resin layer 100. In this embodiment, an epoxy resin is used as the resin for the insulating resin layer 100.

Secondly, referring to FIGS. 4A to 4D, a description will be given hereinbelow of a process of manufacturing the ignition device according to this embodiment.

Figure 4D:
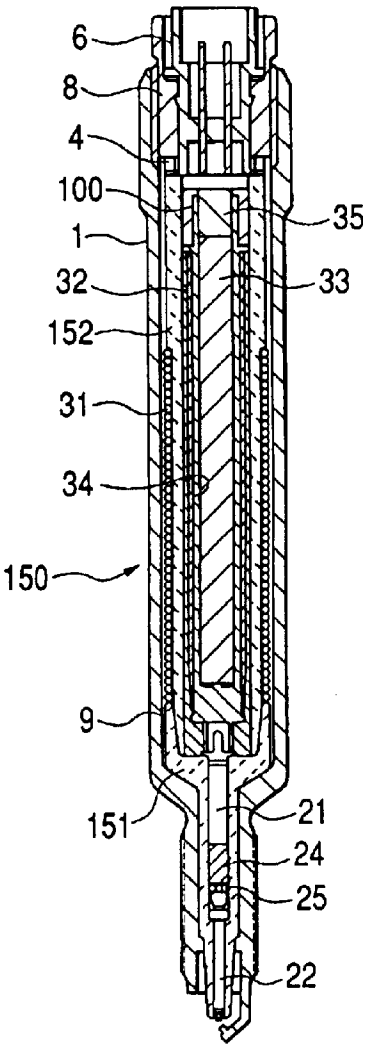
FIGS. 4A to 4D are cross-sectional views showing a process of manufacturing the ignition device according to the second embodiment.
Figure 4C:
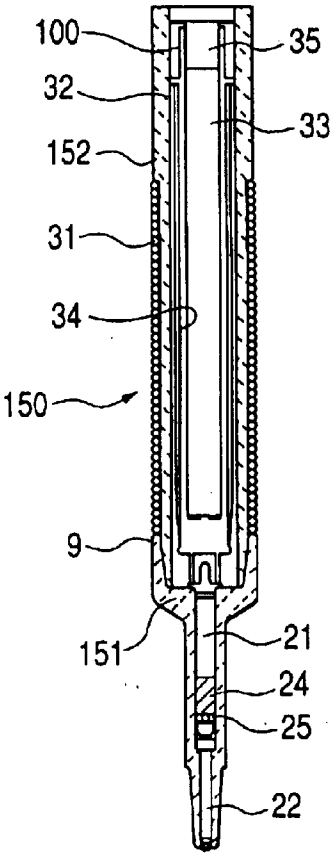
Figure 4B:
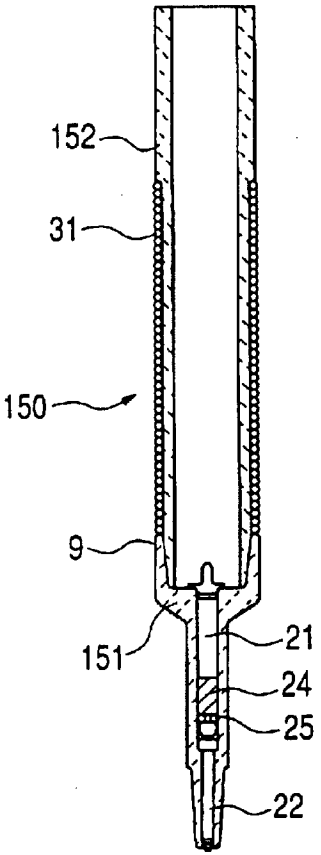
Figure 4A:
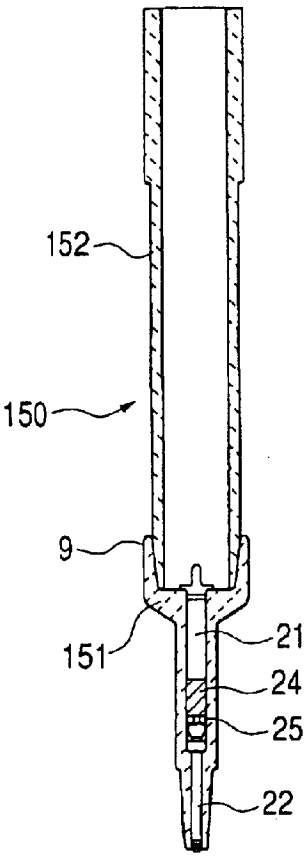
Figure 5:
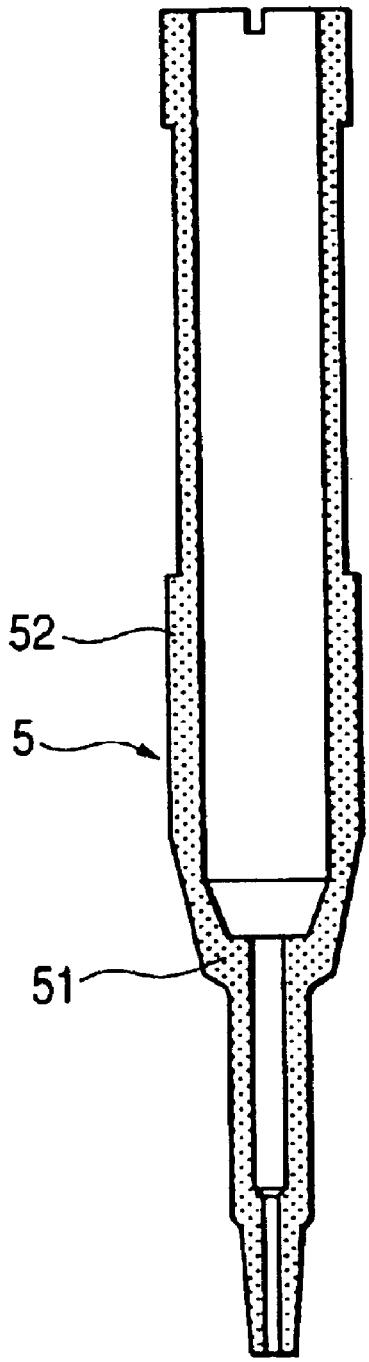
FIG. 5 is a cross-sectional view showing an insulator the inventors have studied in advance.

First, after the plug side tube section 151 and the coil side tube section 152 are formed separately, the insulator 150 is produced according to the procedure described in the first embodiment (see FIG. 4A), and the primary winding 31 is directly wound around an outer circumferential surface of the coil side tube section 152 (see FIG. 4B).

Following this, the secondary spool 34 into which the secondary winding 32, the center core 33 and others are incorporated is inserted into the coil side tube section 152 and the epoxy resin is then put between the coil side tube section 152 and the secondary winding 32 and cured to form the insulating resin layer 100 (see FIG. 4C). Subsequently, the parts in the state shown in FIG. 4C, the pressure detecting element 4, the connector 6, the bolt 8 and others are built in the case 1, thereby completing the ignition device.

The ignition device thus constructed indicates a possibility that cracks occur in the insulating resin layer 100 due to thermal stress in a state where the interface A acts as an origination. At this time, although the cracks grow radially, since the inner circumferential surface side interface A in the combination portion between the plug side tube section 151 and the coil side tube section 152 is out of the axial range B of the secondary winding 32, the cracks of the insulating resin layer 100 does not reach the secondary winding 32. Accordingly, the breakage of the secondary winding 32 does not occur due to the cracks.

(Other Embodiments)

In the above-described embodiments, although the seal layer formation step and the resistor layer formation step are conducted prior to the combination step, it is also appropriate that the combination step, the seal layer formation step and the resistor layer formation step are conducted simultaneously in order to shorten the manufacturing time. Moreover, in a case in which the melting points of the seal material and the resistor material is different from the melting point of the adhesive 9, it is desirable that the site of the seal material or the resistor material and the site of the binding material are heated at different heating temperatures.

Usually, an insulating resin is put in the interior of the insulator 5, and in a case in which a level difference (step) exists on an inner circumferential surface of the combination portion between the plug side tube section 51 and the coil side tube section 52, there is an expected problems in that the insulating resin enters the level difference thereon to easily cause cracks on the insulating resin. For solving this problem, a glaze is applied onto the inner circumferential surface of the combining portion of both the tube sections 51 and 52 and is calcined so that the level difference is filled with the glaze to smooth the inner circumferential surface of the combination portion between both the tube sections 51 and 52, thereby preventing the occurrence of cracks on the insulating resin.

In addition, in the above-described embodiments, although the secondary winding 32 is positioned on the inner circumferential side while the primary winding 31 is positioned on the outer circumferential side, the present invention is not limited to this, but it is also possible that the secondary winding 32 is located on the outer circumferential side while the primary winding 31 is located on the inner circumferential side.

Still additionally, in the above-described embodiments, although a preload is applied to the pressure detecting element 4 with the bolt 8 being tightened, for applying a preload to the pressure detecting element 4, it is also appropriate that a pressing member having no screw is used in place of the bolt 8 and is inserted into the case 1 under pressure, or that the case 1 is caulked after the pressing member is inserted into the case 1. Moreover, it is also acceptable that, after the pressing member is inserted into the case 1, the pressing member is welded to the case 1 in a state where a preload is applied to the pressure detecting element 4.

It should be understood that the present invention is not limited to the above-described embodiments, and that it is intended to cover all changes and modifications of the embodiments of the invention herein which do not constitute departures from the spirit and scope of the invention.

What is claimed is:

1. An ignition device for an internal combustion engine which is equipped with a spark plug made to carry out an electric discharge between an center electrode and an earth electrode and an ignition coil having a primary winding and a secondary winding for supplying a high voltage to said spark plug, with said spark plug and said ignition coil being mounted in a cylinder head of said internal combustion engine in an integrated condition, said ignition device comprising:

a ceramic plug side tube section internally accommodating said center electrode and a ceramic coil side tube section on which one of said primary winding and said secondary winding is wound, with said plug side tube section and said coil side tube section being formed as separate bodies and then combined with each other.

2. The device according to claim 1, wherein the other of said primary winding and said secondary winding is placed in the interior of said coil side tube section, and an inner circumferential surface side interface in a combination portion between said plug side tube section and said coil side tube section is located outside an axial range of said winding placed in the interior of said coil side tube section.

3. A method of manufacturing an ignition device for an internal combustion engine which is equipped with a spark plug made to carry out an electric discharge between an center electrode and an earth electrode and an ignition coil having a primary winding and a secondary winding for supplying a high voltage to said spark plug, with said spark plug and said ignition coil being mounted in a cylinder head of said internal combustion engine in an integrated condition, said method comprising the steps of:

forming a ceramic plug side tube section internally accommodating said center electrode and a ceramic coil side tube section, on which one of said primary winding and said secondary winding is wound, as separate bodies; and combining said plug side tube section with said coil side tube section.

4. The method according to claim 3, wherein a seal layer formation step is conducted to melt a seal material put in the interior of said plug side tube section and then solidify said seal material, and a combination step is then conducted to solidify a binding material after melting for combining said plug side tube section with said coil side tube section.

5. The method according to claim 3, wherein a seal layer formation step is conducted to melt a seal material put in the interior of said plug side tube section and then solidify said seal material, and a combination step is conducted to melt a binding material and then solidify said binding material for combining said plug side tube section with said coil side tube section, with said seal layer formation step and said combination step being conducted simultaneously.

6. The method according to claim 5, wherein, in simultaneously conducting said seal layer formation step and said combination step, a site of said seal material and a site of said binding material are heated at different heating temperatures.

7. The method according to claim 3, wherein a glaze is applied onto an inner circumferential surface of a combination portion between said plug side tube section and said coil side tube section and is calcined.

* * * * *